US006010808A

United States Patent [19]

Naito et al.

[11] Patent Number: 6,010,808

[45] Date of Patent: Jan. 4, 2000

[54] REWRITABLE THERMAL RECORDING MEDIUM AND RECORDING METHOD

[75] Inventors: Katsuyuki Naito, Tokyo; Satoshi Takayama, Kawasaki; Takashi Sasaki, Yokohama, all of Japan

[73] Assignee: Kabushiki Kaisha Toshiba, Kawasaki, Japan

[21] Appl. No.: 09/020,400

[22] Filed: Feb. 9, 1998

[30] Foreign Application Priority Data

Feb. 10, 1997 [JP] Japan ..... 9-026268

[51] Int. Cl.[7] ..... B41M 5/34

[52] U.S. Cl. ..... 430/19; 430/138; 430/964; 503/201; 503/204; 503/226

[58] Field of Search ..... 430/19, 138, 964; 503/204, 201, 226

[56] References Cited

U.S. PATENT DOCUMENTS 5,869,420 2/1999 Naito ..... 503/201

OTHER PUBLICATIONS

Y. Hino et al.; "Rewritable Leuco–Thermal Recording Medium", Japan Hardcopy '90, pp. 147–150.

K. Tsutsui et al.; "Mechanism of New Reversible Thermo–Sensitive Imaging Media Using Organic Long–Chain Compounds", Polymer Preprints, Japan vol. 42, No. 7 (1993) pp. 2736–2738.

Y. Yokota et al.: "Rewritable Thermal Recording Material", Japan Hardcopy '93, pp. 413–416.

*Primary Examiner*—John A. McPherson

*Attorney, Agent, or Firm*—Finnegan, Henderson, Farabow, Garrett & Dunner, L.L.P.

[57] ABSTRACT

A rewritable thermal recording medium of this invention uses a recording material which reversibly changes between an equilibrium state and a quasi-equilibrium state different in color condition from the equilibrium state when a predetermined heat treatment is performed. This rewritable thermal recording medium includes a substrate and a recording layer formed on the substrate. The recording layer has a first region containing a first recording material which takes on lighter color in quasi-equilibrium than in equilibrium, and a second region containing a second recording material which takes on darker color in quasi-equilibrium than in equilibrium.

20 Claims, 3 Drawing Sheets

REWRITABLE THERMAL RECORDING MEDIUM AND RECORDING METHOD

BACKGROUND OF THE INVENTION

The present invention relates to a rewritable thermal recording medium and a recording method by which information can be repetitively recorded and erased by controlling the heat treatment conditions.

Generally, output information from an OA apparatus is printed as a hard copy on a sheet of paper by a printer or displayed as an image formed by a display device. With the recent advance of OA, the amount of data to be processed keeps on increasing accordingly. Therefore, when information is output on sheets of paper, a large amount of sheets must be used, and this is a problem in protecting resources. Also, outputting information to a display device represented by a CRT or an LCD poses the problem of consumption of a large amount of power.

For these reasons, a display means capable of displaying an image with high visibility, capable of repetitively recording and erasing the image, and not requiring energy to hold the image, i.e., a rewritable recording medium, is expected in various fields.

A solid or semisolid recording material is used in a rewritable recording medium. Jpn. Pat. Appln. KOKAI Publication Nos. 55-154198 and 57-82086 have disclosed a rewritable recording medium using a recording material consisting of a low-molecular organic compound and a high-molecular resin matrix. When this recording medium is used, images can be recorded and erased by using a thermal printer head (to be referred to as a TPH hereinafter). Also, this recording medium is well balanced in the above-mentioned characteristics required of a rewritable recording medium. Therefore, the recording medium is beginning to be used as prepaid cards and the like.

Unfortunately, the visibility of a rewritable recording medium using the above recording material is unsatisfactory because recording and erasure of an image are performed by reversibly changing the recording material between an opaque state and a transparent state. Also, this rewritable recording medium itself cannot display color pictures or patterns.

Jpn. Pat. Appln. KOKAI Publication No. 4-50290 has disclosed a composition consisting of a leuco dye and a developer including an acidic group having a developing function and a basic group having a decolorizing function. When a predetermined thermal energy is supplied to this composition, a chemical change can be repetitively caused between a colored state and a decolorized state.

Jpn. Pat. Appln. KOKAI Publication Nos. 4-247985, 4-308790, and 4-344287 have reported compositions prepared by mixing a leuco dye and long-chain phosphonic acid as a developer. When thermal energy is applied, these compositions change their crystal structures and can reversibly change between a colored state and a decolorized state.

Any of the above recording materials is colorless in equilibrium and colors when set in a quasi-equilibrium state by application of a predetermined amount of heat. Accordingly, a rewritable recording medium using any of the above recording materials can perform positive recording and is suited to record characters on a colorless recording surface by using a TPH.

To display, however, an image including a large number of colors by rewritable recording media using only the positive recording materials described above as recording materials, it is necessary to form a recording surface with a predetermined pattern by using recording materials which can take on these colors and to set the recording materials forming the recording surface in a quasi-equilibrium state. For this reason, the above rewritable recording media are not suited to display an image including a large number of colors. Additionally, when such rewritable recording media are used, it is difficult to further record characters or the like in an image in a colored state. As described above, complicated color images are difficult to display by the conventional rewritable recording media.

BRIEF SUMMARY OF THE INVENTION

It is an object of the present invention to provide a rewritable recording medium capable of displaying intricate color images.

To achieve the above object, the present invention provides a rewritable thermal recording medium using a recording material which reversibly changes between an equilibrium state and a quasi-equilibrium state different in color condition from the equilibrium state when a predetermined heat treatment is performed, comprising: a substrate; and a recording layer formed on the substrate and comprising a first region containing a first recording material which takes on lighter color in quasi-equilibrium than in equilibrium, and a second region juxtaposed with the first region and containing a second recording material which takes on darker color in quasi-equilibrium than in equilibrium.

Also, the present invention provides a rewritable thermal recording medium using a recording material which reversibly changes between an equilibrium state and a quasi-equilibrium state different in color condition from the equilibrium state when a predetermined heat treatment is performed, comprising: a substrate; a first recording layer stacked on the substrate; and a second recording layer stacked on the first recording layer, wherein one of the first and second recording layers containing a first recording material which takes on lighter color in quasi-equilibrium than in equilibrium, and the other recording layer containing a second recording material which takes on darker color in quasi-equilibrium than in equilibrium.

Furthermore, the present invention provides a method of recording information on the above rewritable thermal recording medium, comprising the steps of: recording on the recording layer containing the first recording material by using irradiation of light; and recording on the recording layer containing the second recording material is performed by using conduction of heat.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Rewritable thermal recording media of the present invention will be described in more detail below.

Figure 1A:
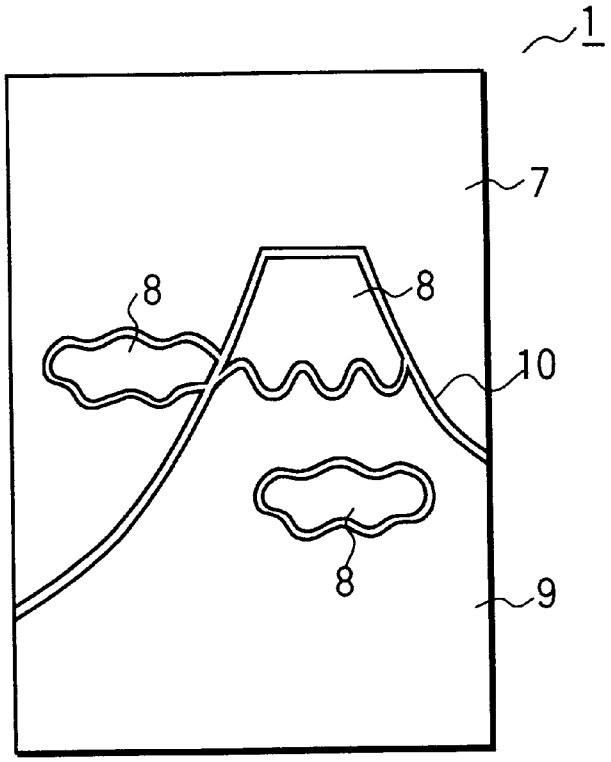
FIGS. 1A and 1B are plan and sectional views, respectively, showing a rewritable thermal recording medium according to the first embodiment of the present invention.
Figure 1B:
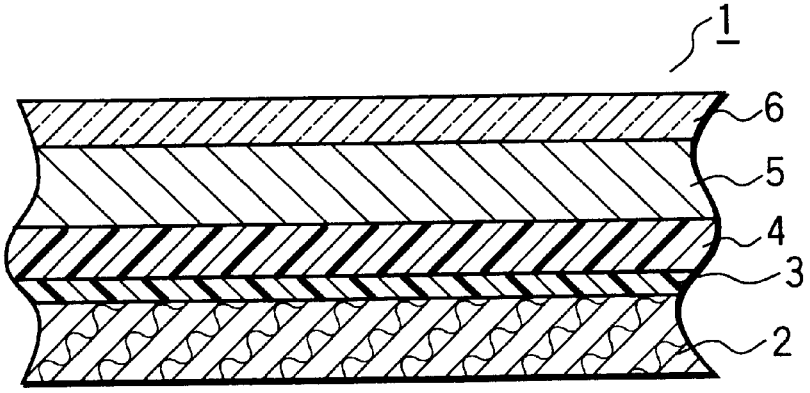

FIGS. 1A and 1B are plan and sectional views, respectively, showing a rewritable thermal recording medium according to the first embodiment of the present invention.

A rewritable thermal recording medium 1 shown in FIGS. 1A and 1B includes a substrate 4, a recording layer 5 stacked on the substrate 4, and a protective layer 6 stacked on the recording layer 5. Also, a member 2 is formed via an adhesive layer 3 on the back surface of the substrate 4 away from the surface on which the recording layer 5 is formed.

As shown in FIG. 1A, the recording layer 5 is constituted by a blue display region 7, a white display region 8, and a red display region 9. These regions 7 to 9 are divided by a partition 10. Referring to FIG. 1A, the rewritable thermal recording medium 1 displays a blue sky, white clouds, and red Mt. Fuji whose summit is covered with snow. However, some other image can also be displayed.

In the above rewritable thermal recording medium 1, the recording layer 5 is constituted by the display regions 7 and 9 containing negative recording materials which eliminate colors when quasi-equilibrated, and the display region 8 containing a positive recording material which takes on color when quasi-equilibrated. That is, the recording layer 5 of the rewritable thermal recording medium 1 is formed by combining the negative display regions 7 and 9 which develop colors in equilibrium and the positive region 8 which loses its color in equilibrium. Note that the quasi-equilibrium state herein mentioned includes a nonequilibrium state which is not an equilibrium state but does not change for long time periods.

In displaying an image having dark and light colors or colors such as black and white by using a conventional rewritable thermal recording medium using only one of negative and positive recording materials, at least a portion of the recording material must be quasi-equilibrated. Therefore, elaborate color images are difficult to display by this rewritable thermal recording medium.

On the other hand, the rewritable thermal recording medium 1 according to the first embodiment of the present invention can display all colors by using recording materials in equilibrium. Therefore, the rewritable thermal recording medium 1 according to the first embodiment of the present invention can display any pictures and graphics.

Also, when the above rewritable thermal recording medium 1 is used, information of characters and graphics can be readily displayed in all of the display regions by using a TPH. For example, in the display region for a light color or white using the positive recording material, colored characters can be displayed by printing character images by a TPH. In the display region for a dark color or black using the negative recording material, white solid characters can be displayed by printing character images by a TPH.

The recording materials used in the display regions 7 to 9 will be described below.

First, the negative recording materials used in the negative display regions 7 and 9 will be described.

Generally, a composition containing a coloring compound and a developer changes its color condition in accordance with a change in the interaction between the coloring compound and the developer. It is known that this composition takes on color when the interaction between the coloring compound and the developer is increased and loses its color when the interaction is decreased.

The present inventors have found that it is possible to obtain a recording material capable of reversibly repetitively changing between a colored state and a decolorized state by further adding a reversing agent to the composition containing the coloring compound and the developer, and have reported a rewritable thermal recording medium using this recording material. Note that the reversing agent herein mentioned is a low-molecular organic compound which interacts with the coloring compound or the developer when fluidized and shows at least two different long-life states when solidified.

In this rewritable thermal recording medium, a colored state can be formed by making the developer and the coloring compound interact with each other. A decolorized state can be formed by making the reversing agent and the developer or the coloring compound interact with each other so that the interaction between the developer and the coloring compound is inhibited. That is, the above rewritable thermal recording medium is suitable for so-called negative recording in which characters etc are recorded by using a TPH and erased by using a hot stamp.

The control of the colored state described above, i.e., the control of the interaction between the coloring compound and the developer is done as follows. In the above recording material, the coloring compound and the developer excessively exist compared to the equilibrium solubility in the reversing agent. Therefore, in equilibrium state, portions of the coloring compound and the developer are phase-separated from the reversing agent. The coloring agent and the developer thus phase-separated from the reversing agent are unaffected by the reversing agent and can therefore interact. Accordingly, the above recording material colors in equilibrium.

The colored state is changed to the decolorized state by quasi-equilibrating the recording material. That is, the recording material in equilibrium is first heated to well dissolve the whole coloring compound and developer in the reversing agent. By this heating, the coloring compound, the developer, and the reversing agent are evenly mixed to cause an interaction between the revering agent and the coloring compound or the developer. As a consequence, the recording material is set in the decolorized state. When this recording material is rapidly cooled, the coloring compound and the developer solidify without phase separation from the reversing agent. Accordingly, the decolorized state is maintained even in the solidified recording material.

The change between the equilibrium state and the quasi-equilibrium state described above can also be a change between one crystalline state and another crystalline state or a change between one amorphous state and another amorphous state. However, this change is preferably a change between a crystalline state and an amorphous state. The crystallinity in each of the equilibrium and quasi-equilibrium states can be controlled by properly selecting the type of reversing agent to be contained in the recording material.

Details of the above change will be described below with reference to FIG. 2.

Figure 2:
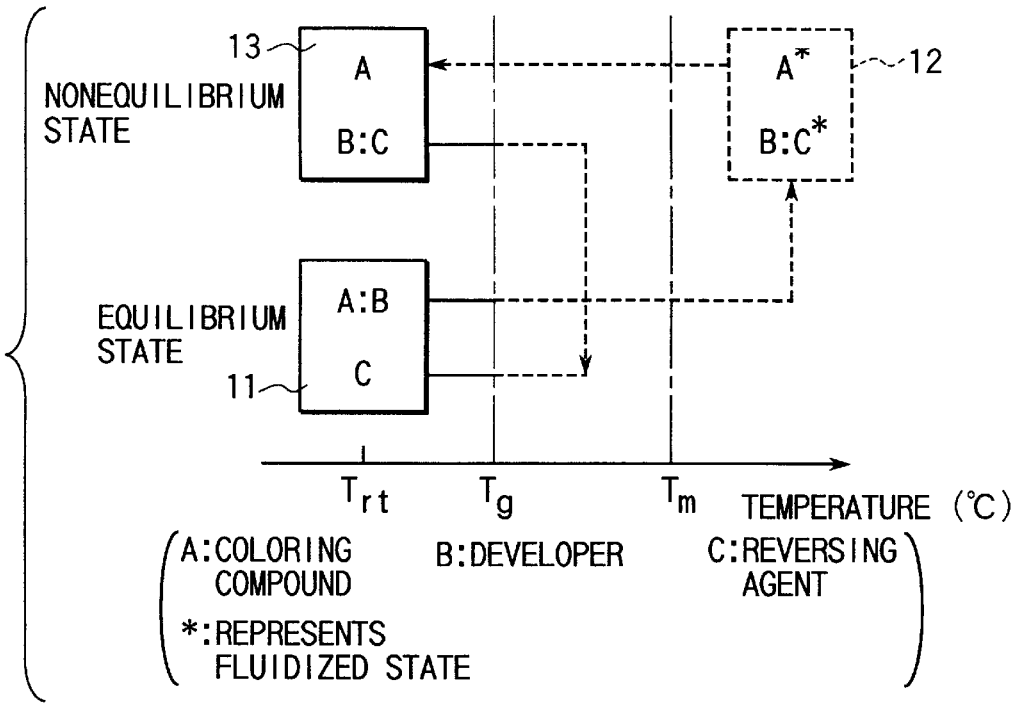
FIG. 2 is a view schematically showing changes in the state of a recording material used in the rewritable thermal recording medium according to the first embodiment of the present invention.

FIG. 2 is a view schematically showing changes in the state of the recording material used in the rewritable thermal recording medium according to the first embodiment of the present invention. In FIG. 2, the abscissa indicates the temperature.

In the recording material in an equilibrium state 11 at room temperature ($T_{rt}$), a coloring compound A and a developer B are phase-separated from a reversing agent C because the coloring compound A and the developer B excessively exist compared to the equilibrium solubility in the reversing agent C. As a consequence, the recording material colors. When the recording material in this state is heated to its melting point ($T_m$) or higher, the recording material is fluidized. Consequently, the interaction between the coloring compound A and the developer B disappears, and, for example, an interaction occurs between the developer B and the reversing agent C. That is, the recording material changes from the colored state 11 to a decolorized state 12.

Subsequently, the recording material in the molten state 12 is rapidly cooled. Consequently, the coloring compound A, the developer B, and the reversing agent C solidify without phase separation. That is, the reversing agent C changes into an amorphous state by incorporating the coloring compound A and the developer B at a concentration exceeding the equilibrium solubility. As a result, the interaction between the coloring compound A and the developer B is maintained even in the solidified state, and the recording material is set in a decolorized state 13.

When the recording material in this decolorized state 13 is heated to a temperature higher than its glass transition temperature ($T_g$), the diffusion rate of the developer B in the recording material is abruptly raised. Accordingly, the phase separation between the developer B and the reversing agent C is accelerated so that the recording material changes from the quasi-equilibrium state 13 to the equilibrium state 11.

At a temperature ($T_c'$) at which the change of the recording material from the quasi-equilibrium state 13 to the equilibrium state 11, i.e., the change from the decolorized state to the colored state caused by the phase separation is well achieved in a predetermined time, the reversing agent C from which the developer B is phase-separated rapidly crystallizes. Therefore, the lower-limit value of the color development temperature $T_c'$ can be substantially considered to be a crystallization temperature ($T_c$).

When the recording material in the quasi-equilibrium state 13 is heated at a temperature within the range from the crystallization temperature $T_c$ to the melting point $T_m$ for a predetermined time, the recording material changes into a phase-separated state closer to the equilibrium state and takes on color. Accordingly, the phase change between the equilibrium state and the quasi-equilibrium state can be repetitively caused by appropriately supplying thermal energies with different magnitudes capable of heating the reversing agent C to a temperature from the crystallization temperature $T_c$ to less than the melting point $T_m$ and to a temperature equal to or higher than the melting point $T_m$. That is, the change between the colored state and the decolorized state can be repetitively caused. Strictly speaking, the colored state depends upon the equilibrium solubility or the phase-separated state of the developer. Therefore, it is necessary to consider the fact that the color development concentration of the recording material is affected by the heating temperature and the heating time.

The recording material described above is a negative recording material which takes on color in an equilibrium state (crystalline state) and loses its color in a quasi-equilibrium state (amorphous state). In the negative recording material, the rate of change from a decolorized state to a colored state, i.e., the color development rate generally conflicts with the stability of the decolorized state. Therefore, when the negative recording material is constituted only by three components, i.e., a coloring compound, a developer, and a reversing agent, these two characteristics are difficult to simultaneously improve.

To solve this problem, it is preferable to further add a phase separation controlling agent to the recording material constituted by the above three components, thereby constituting the recording material by the four components. The phase separation controlling agent herein mentioned is a thermoplastic low-molecular organic material having the following properties. That is, the phase separation controlling agent has a melting point lower than the melting point of the composition consisting of the coloring compound, the developer, and the reversing agent and largely changes its ability to dissolve the coloring compound or the developer before and after this melting point. In other words, the phase separation controlling agent has a function of abruptly changing the rate of phase separation near the melting point. Also, the interaction between a fused phase separation controlling agent and the coloring compound or the developer is weaker than the interaction between a dissolved or fused reversing agent and the coloring compound or the developer.

In the recording material containing the phase separation controlling agent described above, at a temperature lower than the melting point the phase separation controlling agent has little influence on the interaction between the coloring compound and the developer. That is, at a temperature lower than the melting point, the rate at which the coloring compound or the developer diffuses into the phase separation controlling agent is low, so the phase separation controlling agent has little influence on the colored state. On the other hand, when the recording material containing the phase separation controlling agent is heated to the melting point or higher, the equilibrium solubility of the coloring compound or the developer with respect to the phase separation controlling agent largely increases. This largely increases the rate of diffusion of the coloring compound or the developer into the phase separation controlling agent. That is, by the use of the phase separation controlling agent which largely changes its ability to dissolve the coloring compound or the developer before and after the melting point, it is possible to institute the change between the equilibrium state and the quasi-equilibrium state at a high speed and increase the stability in the quasi-equilibrium state. Details of the state change of the above recording material will be described below with reference to FIG. 3.

Figure 3:
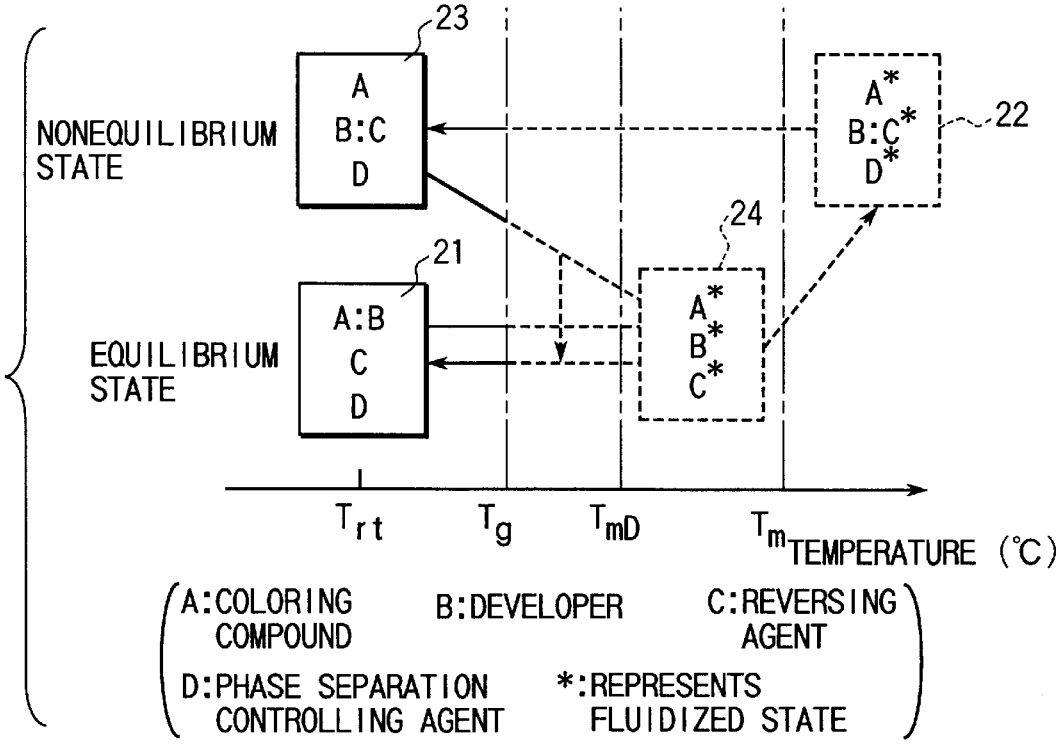
FIG. 3 is a view schematically showing changes in the state of a recording material used in the rewritable thermal recording medium according to the first embodiment of the present invention.

FIG. 3 is a view schematically showing changes in the state of the recording material used in the rewritable thermal recording medium according to the first embodiment of the present invention. In FIG. 3, the abscissa indicates the temperature.

At room temperature ($T_{rt}$), a recording material containing a coloring compound A, a developer B, a reversing agent C, and a phase separation controlling agent D can take two states 21 and 23. In the state 21, the recording material is separated into a phase substantially consisting of the coloring compound A and the developer B, a phase primarily consisting of the reversing agent C, and a phase primarily consisting of the phase separation controlling agent D, and the recording material is in a colored state. The state 21 is more equilibrium than the state 23.

When the recording material in the state 21 is heated to its melting temperature ($T_m$) or higher, the recording material is fluidized. In this state, the interaction between the coloring compound A and the developer B disappears, and, for example, an interaction occurs between the developer B and the reversing agent C. As a consequence, the recording material changes into a decolorized state 22.

When the recording material in this decolorized state 22 is cooled, a compatible product of the reversing agent C and the phase separation controlling agent D becomes a supercooled liquid which holds fluidity even at the melting temperature $T_m$ or lower, unlike when the phase separation controlling agent D is not used. Furthermore, the interaction between the developer B and the fluidized reversing agent C is maintained even when this recording material is cooled, and the recording material solidifies at a glass transition temperature ($T_g$) or lower. The solidified recording material is amorphous and in quasi-equilibrium state. Also, the reversing agent C incorporates the developer B at a concentration exceeding the equilibrium solubility and inhibits the interaction between the coloring compound A and the developer B. As a consequence, the recording material changes into the decolorized state 23.

As described above, the quasi-equilibrium state 23 can be obtained, regardless of the cooling rate, by the four-component recording material containing the phase separation controlling agent D. That is, the recording material can be changed between the equilibrium state 21 and the quasi-equilibrium state 23 only by controlling the heating temperature. Additionally, even in the four-component recording material, the quasi-equilibrium state 23 is extremely stable at the glass transition temperature $T_g$ or lower and does not easily change to the equilibrium state 21 as long as the temperature is $T_g$ or lower.

When the recording material in the quasi-equilibrium state 23 is heated to a temperature from the glass transition temperature $T_g$ to lower than the melting point ($T_{mD}$) of the phase separation controlling agent D, the diffusion rate of the developer B in the recording material is abruptly raised as when the phase separation controlling agent D is not used. When the recording material is further heated to the melting point $T_{mD}$ of the phase separation controlling agent D or higher, the liquefied phase separation controlling agent D dissolves portions of the developer B and the reversing agent C. As a consequence, the phase separation between the developer B and the reversing agent C is greatly promoted by a dramatic increase in the diffusion rate of the coloring compound A or the developer B, and the association between the coloring compound A and the developer B ends in a short time period. At this point, however, the developer B does not interact with the coloring compound A, so the recording material is in a decolorized or semi-decolorized state 24.

When the recording material in this state 24 is cooled to a temperature lower than the melting point $T_{mD}$ of the phase separation controlling agent D, the coloring compound A and the developer B phase-separated from the reversing agent C interact with each other, and the recording material changes into the more equilibrium colored state 21.

In the recording material containing the phase separation controlling agent described above, the rate of change from the decolorized state 23 to the colored state 21, i.e., the color development rate changes by two to four orders of magnitude before and after the glass transition temperature $T_g$ and further changes by three to four orders of magnitude before and after the melting point $T_{mD}$. In the recording material containing the phase separation controlling agent, therefore, the phase change between the equilibrium state and the quasi-equilibrium state can be repetitively caused at a very high speed by appropriately supplying thermal energies with different magnitudes capable of heating to a temperature from the melting point $T_{mD}$ of the phase separation controlling agent to lower than the melting point $T_m$ of the recording material and to a temperature equal to or higher than the melting point $T_m$. That is, the change between the colored state and the decolorized state can be repetitively produced at a very high speed. Also, as described above, the recording material containing the phase separation controlling agent can be changed to the equilibrium state 21 or the quasi-equilibrium state 23 regardless of whether the cooling rate is high or low.

The positive recording material which loses its color in equilibrium and takes on color in quasi-equilibrium will be described below.

An example of the positive recording material used in the rewritable thermal recording medium according to the first embodiment of the present invention is a composition containing a coloring compound and a developer having a long-chain alkyl group. The developer having a long-chain alkyl group herein mentioned has a structure in which a plurality of fused rings are connected.

When the positive recording material having the above composition is in equilibrium, the coloring compound and the developer are phase-separated because the developer has high ability to crystallize. In equilibrium, therefore, the interaction between the coloring compound and the developer is small, and the color development concentration of the recording material is low. In quasi-equilibrium, on the other hand, the coloring compound and the developer mix, and the interaction between the coloring compound and the developer is large. Accordingly, the recording material takes on color in quasi-equilibrium.

In the positive recording material, as in the case of the negative recording material, the phase change between the equilibrium state and the quasi-equilibrium state can be reversibly caused at a very high speed by the addition of a phase separation controlling agent. Also, the positive recording material to which the phase separation controlling agent is added can be changed to the equilibrium state or the quasi-equilibrium state regardless of whether the cooling rate is high or low.

In the rewritable thermal recording medium according to the first embodiment of the present invention, the melting point of the developer used in the positive recording material is preferably 100° C. or more for the reason explained below. In the rewritable thermal recording medium according to the first embodiment of the present invention, the positive and negative recording materials are used, and the negative recording material contains a reversing agent. Generally, a recording material containing a reversing agent has a high melting point and a high crystallization temperature. Therefore, if the melting point of the developer used in the positive recording material is lower than 100° C., the developer used in the positive recording material melts when the negative recording material takes on color (changes from the quasi-equilibrium state to the equilibrium state). When the positive recording material in which the developer has thus melted is cooled, this positive recording material changes into the quasi-equilibrium state. Accordingly, if the melting point of the developer used in the positive recording material is less than 100° C., the negative and positive recording materials cannot be simultaneously equilibrated.

In the negative and positive recording materials described above, if the glass transition temperature $T_g$ is as low as about room temperature, the coloring compound or the developer sometimes diffuses due to a slight rise in the ambient temperature. Since this diffusion promotes phase separation and crystallization, the stability of recording tends to decrease. Therefore, the glass transition temperature $T_g$ of an amorphous substance formed by the whole recording material or a portion of the recording material is preferably 25° C. or more, and more preferably, 50° C. or more. When this is taken into consideration, as the coloring compound it is preferable to use a compound having a large molecular weight and a small fusion enthalpy ΔH per unit weight. For example, it is preferable to use a compound having a shape close to a sphere and a bulky molecular skeleton or a compound having a plurality of sites capable of forming hydrogen bonds between molecules.

In contrast, when a recording material whose glass transition temperature $T_g$ is close to room temperature is used, for example, it is possible to realize a rewritable thermal recording medium in which recorded information is held for a predetermined period and naturally erased after an elapse of the period.

In special applications, a recording material whose glass transition temperature $T_g$ is lower than room temperature can be used. For example, when a rewritable thermal recording medium using a recording material whose glass transition temperature $T_g$ is lower than room temperature is used in a refrigerator for storing substances requiring refrigeration, a temporary temperature rise resulting from malfunction or transportation of the refrigerator can be indicated by a change in the color condition brought about by crystallization of the recording material.

If the glass transition temperature $T_g$ of the recording material is too high, a large thermal energy is necessary in recording and erasure of information. This is disadvantageous in respect of energy saving. Therefore, the glass transition temperature $T_g$ of the recording material is preferably 150° C. or less.

The glass transition temperature $T_g$ of the recording material has been described above. It is generally known that the glass transition temperature $T_g$ of a mixture is close to the weight-average value of the glass transition temperatures of its components. Therefore, to control the glass transition temperature $T_g$ of the above recording material to a desired value, it is effective to control the types or the mixing ratio of the components of the recording material.

For the same reason as above, the glass transition temperature $T_g$ of each of the coloring compound, the developer, and the reversing agent contained in the recording material is preferably 25° C. or more, and more preferably, 50° C. or more. Also, the melting point of the reversing agent is preferably 100° C. or more to obtain high recording stability.

The glass transition temperatures $T_g$ of the recording material and its components can be measured by using, e.g., a differential scanning calorimeter (DSC). This measurement can be performed for the recording material or for each component of the recording material.

In a compound which has a clear glass transition temperature $T_g$ and easily forms an amorphous substance, a relationship of $T_g = \cdot T_m$ generally holds between the glass transition temperature $T_g$ and the melting point $T_m$ (a is a constant from 0.65 to 0.8, and $T_g$ and $T_m$ are the absolute temperatures). Therefore, if the glass transition temperature $T_g$ of the recording material or a component contained in the recording material is high, the melting point $T_m$ of the recording material is also high. If this is the case, the stability of recording can be improved, but it is necessary to heat the recording material to a very high temperature in order to fuse the recording material. As a consequence, a substrate or a protective film is required to have high heat resistance, and this deteriorates the practicality.

To avoid these problems, the use of a recording material which has a plurality of crystal structures is effective. To obtain a recording material which has a plurality of crystal structures, it is only necessary to use a compound having a plurality of crystal structures as the developer or the reversing agent contained in the recording material.

In the rewritable thermal recording medium according to the first embodiment of the present invention, the mixing ratio of the coloring compound and the developer contained in the positive recording material is preferably 0.02 to 100 parts by weight, and more preferably, 0.2 to 5 parts by weight of the developer with respect to 1 part by weight of the coloring compound. If the mixing ratio of the developer is less than 0.02 part by weight, it is difficult to well increase the interaction between the coloring compound and the developer in recording or erasure. If the mixing ratio of the developer exceeds 100 parts by weight, the color development density in the colored state tends to decrease.

On the other hand, the mixing ratio of the coloring compound and the developer contained in the negative recording material is preferably 0.1 to 10 parts by weight, and more preferably, 1 to 2 parts by weight of the developer with respect to 1 part by weight of the coloring compound. If the mixing ratio of the developer is less than 0.1 part by weight, it is difficult to well increase the interaction between the coloring compound and the developer in recording or erasure. If the mixing ratio of the developer exceeds 10 parts by weight, it is difficult to well decrease the interaction between the coloring compound and the developer in recording or erasure.

The mixing ratio of the coloring compound and the reversing agent contained in the negative recording material is preferably 1 to 200 parts by weight, and more preferably, 10 to 100 parts by weight of the reversing agent with respect to 1 part by weight of the coloring compound. If the mixing ratio of the reversing agent is less than 1 part by weight, it is difficult to produce the crystalline-amorphous transition or the change between the mixed state and the phase-separated state in the recording material. If the mixing ratio of the reversing agent exceeds 200 parts by weight, the color development concentration in the colored state tends to decrease.

When the phase separation controlling agent is added to the negative recording material, the mixing ratio of the coloring compound and the phase separation controlling agent is preferably 0.1 to 100 parts by weight, and more preferably, 1 to 50 parts by weight of the phase separation controlling agent with respect to 1 part by weight of the coloring compound. If the mixing ratio of the phase separation controlling agent is less than 0.1 part by weight, it is almost impossible to obtain the effect of increasing the phase separation rate of the recording material. If the mixing ratio of the phase separation controlling agent exceeds 100 parts by weight, the quasi-equilibrium state of the recording material becomes unstable, and this can lower the stability of recording.

Examples of the coloring compound used in the rewritable thermal recording medium according to the first embodiment of the present invention described above are electron donating organic substances such as leucoauramines, diarylphthalides, polyarylcarbinols, acylauramines, arylauramines, rhodamine B lactam, indolines, spiropyrans, and fluorans. More specific examples are crystal violet lactone (CVL), malachite green lactone, 2-anilino-6-(N-cyclohexyl-N-methylamino)-3-methylfluoran, 2-anilino-3-methyl-6-(N-methyl-N-propylamino)fluoran, 3-[4-(4-phenylaminophenyl) aminophenyl]amino-6-methyl-7-chlorofluoran, 2-anilino-6-(N-methyl-N-isobutylamino)-3-methylfluoran, 2-anilino-6-(dibutylamino)-3-methylfluoran, 3-chloro-6-(cyclohexylamino)fluoran, 2-chloro-6-(diethylamino) fluoran, 7-(N,N-dibenzylamino)-3-(N,N-diethylamino) fluoran, 3,6-bis(diethylamino)fluoran-γ-(4'-nitro) anilinolactam, 3-diethylaminobenzo[a]-fluoran, 3-diethylamino-6-methyl-7-aminofluoran, 3-diethylamino-7-xylidinofluoran, 3-(4-diethylamino-2-ethoxyphenyl)-3-(1-ethyl-2-methylindole-3-yl)-4-azaphthalide, 3-(4-diethylaminophenyl)-3-(1-ethyl-2-methylindole-3-yl) phthalide, 3-diethylamino-7-chloroanilinofluoran, 3-dimethylamino-7,8-benzofluoran, 3,3-bis(1-n-butyl-2-methylindole-3-yl)phthalide, 3,6-dimethylethoxyfluoran, 3-diethylamino-6-methoxy-7-aminofluoran, DEPM, ATP, ETAC, 2-(2-chloroanilino)-6-dibutylaminofluoran, crystal violet carbinol, malachite green carbinol, N-(2,3-dichlorophenyl)leucoauramine, N-benzoylauramine, rhodamine B lactam, N-acetylauramine, N-phenylauramine, 2-(phenyliminoethanedilidene)-3,3-dimethylindoline, N-3, 3-trimethylindolinobenzospiropyran, 8'-methoxy-N-3,3-trimethylindolinobenzospiropyran, 3-diethylamino-6-methyl-7-chlorofluoran, 3-diethylamino-7-methoxyfluoran, 3-diethylamino-6-benzyloxyfluoran, 1,2-benz-6-diethylaminofluoran, 3,6-di-p-toluidino-4,5-dimethylfluoran-phenylhydrazido-γ-lactam, and 3-amino-5-methylfluoran.

These coloring compounds can be used singly, or a plurality of different coloring compounds can be mixed. Therefore, the recording material can be made to develop a desired color by properly selecting the type of coloring compound or, when a plurality of different coloring compounds are to be used, by appropriately selecting the types and the mixing ratio of these compounds.

Examples of the developer used in the rewritable thermal recording medium according to the first embodiment of the present invention are phenols, phenol metal salts, carboxylic acid metal salts, benzophenones, sulfonic acid, sulfonates, phosphoric acids, phosphoric acid metal salts, acidic phosphoric acid esters, acidic phosphoric acid ester metal salts, phosphorous acids, and phosphorous acid metal salts. These developers can be used singly, or a plurality of different developers can be mixed.

The reversing agent used in the rewritable thermal recording medium according to the first embodiment of the present invention is preferably a compound having a bulky molecular skeleton, such as a steroid skeleton, whose shape is close to a cylinder, and having an alcohol group. A low-molecular compound having a molecular weight of less than 100 is unsuitable as the reversing agent. Also, even if the molecular weight is 100 or more, a long-chain alkyl derivative or a planar aromatic compound is unsuitable as the reversing agent.

Preferable examples of the reversing agent are steroid-based alcohols such as cholesterol, stigmasterol, pregnenolone, methylandrostenediol, estradiolbenzoate, epiandrostene, stenolone, β-sitosterol, pregnenoloneacetate, β-cholestarol, 5,16-pregnadiene-3β-ol-20-one, 5α-pregnene-3β-ol-20-one, 5-pregnene-3β,17-diol-20-one 21-acetate, 5-pregnene-3β,17-diol-20-one 17-acetate, 5-pregnene-3β,21-diol-20-one 21-acetate, 5-pregnene-3β, 17-dioldiacetate, rockogenin, tigogenin, esmiragenin, hecogenin, diosgenin, and their derivatives and mixtures.

The phase separation controlling agent used in the rewritable thermal recording medium according to the first embodiment of the present invention is preferably a low-molecular organic material consisting of a straight-chain (—$(CH_2)_n$—) portion having eight or more carbon atoms and a polar group (e.g., —OH, >CO, or —COOH group) and having high ability to crystallize. Examples of the phase separation controlling agent are straight-chain higher monovalent alcohol such as 1-docosanol, 1-tetracosanol, 1-hexacosanol, and 1-octacosanol; straight-chain higher polyvalent alcohol such as 1,12-dodecanediol, 1,12-octadecanediol, 1,2-tetradecanediol, and 1,2-hexadecanediol; straight-chain higher fatty acid such as behenic acid, 1-docosanoic acid, 1-tetracosanoic acid, 1-hexacosanoic acid, and 1-octacosanoic acid; straight-chain higher polyvalent fatty acid such as dodecane 2 acid and 1,12-dodecanedicarboxylic acid; straight-chain higher ketone such as stearone; straight-chain higher fatty acid alcoholamide such as isopropanolamide stearate, isopropanolamide behenate, and hexanolamide behenate; and straight-chain higher fatty acid dioldiester such as diester ethyleneglycollaurate, diester catechollaurate, and diester cyclohexanediollaurate. Also, some mixtures, such as ester wax, alcohol wax, and urethane wax, consisting of a plurality of different materials, can be used as the phase separation controlling agent.

In addition to the coloring compound, developer, reversing agent, and phase separation controlling agent described above, the rewritable thermal recording medium according to the first embodiment of the present invention can contain a coloring dye, a fluorescent dye, an ultraviolet absorbent, a heat insulation material, and a heat storage material. When a dye, such as a coloring dye, which does not change its color upon rewriting is added to the recording material, the recording material can be colored in both the equilibrium and quasi-equilibrium states, and different colors can be obtained in these two states. In particular, a yellow dye is convenient for display purposes.

The display regions 7 to 9 described above are formed on the substrate 4 made of a plastic film such as a polyethyleneterephthalate film, a plastic plate, a metal plate, a semiconductor substrate, a glass plate, a wood plate, paper, cloth, or an OHP sheet. The formation of the display regions 7 to 9 on the substrate 4 can be performed by, e.g., extending a thin recording material on the substrate 4 or dissolving or dispersing the recording material in an appropriate solvent and applying and drying the resultant material. Note that a proper surface treatment can also be performed on the surface of the substrate 4 in order to improve the adhesion between the surface and the display regions 7 to 9 and improve the solvent resistance.

The thickness of the display regions 7 to 9 formed as above is preferably 0.5 to 50 μm. If the thickness is less than 0.5 μm, the color development concentration in the colored state can become unsatisfactory. If the thickness exceeds 50 μm, a large thermal energy is necessary in recording or erasing information, and this makes high-speed recording or erasure difficult.

In the rewritable thermal recording medium according to the first embodiment of the present invention, the display regions 7 to 9 are preferably divided by the partition 10. When the display regions are thus divided by the partition 10, it is possible to prevent the mixing of the recording materials between the individual display regions and consequently prevent a lowering in the color mixing or rewriting characteristic. Note that the partition 10 is not particularly limited as long as the partition prevents the mixing of the recording materials between adjacent display regions and is not denatured by a rewrite of the rewritable thermal recording medium 1.

The rewritable thermal recording medium according to the first embodiment of the present invention preferably has a mechanism for preventing damages or the like to the display regions 7 to 9.

For example, the durability of the recording layer 5 having the display regions 7 to 9 can be improved by forming the protective layer 6 made of a transparent film or the like on the recording layer 5. The formation of the protective layer 6 can also prevent sticking to a TPH. Examples of the material of the protective layer 6 are wax, a thermoplastic resin, a thermosetting resin, a photosetting resin, a water-soluble resin, and latex.

The thickness of the protective layer 6 is preferably about 0.1 to 100 $\mu$m. Also, the protective layer 6 can contain, e.g., a heat mold release agent, a lubricant, a heat-resistant material, and an antistatic agent.

The protective layer 6 can be formed by, e.g., dissolving or dispersing the material of the protective layer 6 in a predetermined solvent and applying and drying the resultant solution or dispersion on the recording layer 5. The protective layer 6 can also be formed by adhering a heat-resistant film, one surface of which is previously coated with an adhesive, onto the recording layer 5 by a dry laminating method.

The heat-resistant film used as the protective layer 6 is not particularly restricted as long as the film is a transparent film which does not deform at the melting point of the recording material or higher. Examples of the heat-resistant film are sheets of high-molecular compounds such as polyetheretherketones; polycarbonates; polyallylates; polysulfones; ethylene tetrafluoride resins; ethylene tetrafluoride copolymers such as an ethylene tetrafluoride.perfluoroalkoxyethylene copolymer, an ethylene tetrafluoride.perfluoroalkylvinylether copolymer, an ethylene tetrafluoride.propylene hexafluoride copolymer, and an ethylene tetrafluoride.ethylene copolymer; ethylene chloride trifluoride resins; vinylidene fluoride resins; silicone resins; fluorine-containing polybenzoxazoles; polypropylenes; polyvinylalcohols; polyvinylidene chlorides; polyesters such as polyethyleneterephthalate, polybutyreneterephthalate, and polyethylenenaphthalate; polystyrenes; polyamides such as nylon 66; polyimides; polyimidoamides; polyethersulfones; polymethylpentenes; polyetherimides; polyurethanes; and polybutadienes. These high-molecular compounds can be properly selectively used in accordance with the type of heat source or the application or form of the rewritable thermal recording medium.

The adhesive for adhering the above heat-resistant film and the recording layer 5 can be any adhesive commonly used in dry lamination. Examples are acrylic resins; phenoxy resins; ionomer resins; ethylene copolymers such as an ethylene.vinyl acetate copolymer and an ethylene.acrylic acid.maleic anhydride copolymer; polyvinylethers; polyvinylformals; polyvinylbutyrals; gelatin; gum arabic; polyesters; polystyrenes; styrene copolymers such as a styrene-.acrylic acid copolymer; vinyl acetate resins; polyurethanes; xylene resins; epoxy resins; phenolic resins; and urea resins.

The display regions 7 to 9 can also be protected by some other methods. That is, the display regions 7 to 9 can be formed on the substrate 4 by using methods of impregnating a polymer sheet or a porous material with the recording material, dispersing the recording material in a binder polymer or inorganic glass, intercalating the recording material into a layered substance, and microcapsulating the recording material. When the display regions 7 to 9 are formed by any of these methods, the strength of the display regions 7 to 9 is improved.

To impregnate a polymer sheet with the recording material, a polymer sheet having surfaces in which spaces capable of holding the recording material are formed is dipped into a molten recording material or a solution prepared by dissolving the recording material in a predetermined solvent. This polymer sheet preferably has high wettability to the molten recording material or to the solution prepared by dissolving the recording material in a predetermined solvent. By the use of this polymer sheet, the display regions 7 to 9 can be formed with a uniform thickness.

Examples of the material of the polymer sheet are polyetheretherketones; polycarbonates; polyallylates; polysulfones; ethylene tetrafluoride resins; ethylene tetrafluoride copolymers such as an ethylene tetrafluoride.perfluoroalkoxyethylene copolymer, an ethylene tetrafluoride.perfluoroalkylvinylether copolymer, an ethylene tetrafluoride.propylene hexafluoride copolymer, and an ethylene tetrafluoride.ethylene copolymer; ethylene chloride trifluoride resins; vinylidene fluoride resins; fluorine-containing polybenzoxazoles; polypropylenes; polyvinylalcohols; polyvinylidene chlorides; polyesters such as polyethyleneterephthalate, polybutyreneterephthalate, and polyethylenenaphthalate; polystyrenes; polyamides such as nylon 66; polyimides; polyimidoamides; polyethersulfones; polymethylpentenes; polyetherimides; polyurethanes; polybutadienes; celluloses such as methylcellulose, ethylcellulose, cellulose acetate, and nitrocellulose; gelatin; gum arabic; and papers such as neutral paper and acidic paper. Celluloses and neutral paper are particularly preferable because they allow easy permeation of the molten recording material or the solution prepared by dissolving the recording material in a predetermined solvent and also increase the contrast ratio of the colored state to the decolorized state of the rewritable thermal recording medium.

To disperse the recording material in a binder polymer, the recording material is first melted or dissolved in a predetermined solvent. Next, other components are added, where necessary, to the molten recording material or the solution, and the resultant material is dispersed in a binder polymer by any of various dispersion methods. A substrate is coated with the resultant dispersion to form the display regions 7 to 9.

Examples of the method of dispersing the molten recording material or the solution in a binder polymer are a mixer method, a sand mill method, a ball mill method, an impeller mill method, a colloid mill method, a three-roll mill method, a kneader method, a two-roll mill method, a Banbury mixer method, a homogenizer method, and a nanomizer method. One of these dispersion methods to be used can be properly selected in accordance with the viscosity of the molten recording material or the solution and the application and form of the rewritable thermal recording method.

Examples of the method of coating the substrate with the molten recording material or the solution are spin coating, pulling coating, air doctor coating, blade coating, rod coating, knife coating, squeeze coating, impregnating coating, reverse roll coating, transfer coating, gravure coating, kiss-roll coating, cast coating, spray coating, curtain coating, calender coating, extrusion coating, and electrostatic coating. These coating methods can be appropriately chosen in accordance with the application and form of the rewritable thermal recording medium.

To disperse the recording material in a binder polymer, the mixing ratio of the binder polymer is preferably 0.01 to 100 parts by weight, and more preferably, 0.05 to 20 parts by weight with respect to 1 part by weight of the coloring compound. If the mixing ratio of the binder polymer is less than 0.01 part by weight, the strength of the display regions 7 to 9 cannot be well improved. If the mixing ratio exceeds 100 parts by weight, the color development concentration in the colored state tends to decrease.

Examples of the material of the binder polymer are thermoplastic resins such as polyethylenes; chlorinated polyethylenes; ethylene copolymers such as an ethylene.vinyl acetate copolymer and an ethylene.acrylic acid.maleic anhydride copolymer; polybutadienes; polyesters such as polyethyleneterephthalate, polybutyleneterephthalate, and polyethylenenaphthalate; polypropylenes; polyisobutylenes; polyvinyl chlorides; polyvinylidene chlorides; polyvinyl acetates; polyvinylalcohols; polyvinylacetals; polyvinylbutyrals; ethylene tetrafluoride resins; ethylene chloride trifluoride resins; ethylene fluoride.propylene resins; vinylidene fluoride resins; vinyl fluoride resins; ethylene tetrafluoride copolymers such as an ethylene tetrafluoride-.perfluoroalkoxyethylene copolymer, an ethylene tetrafluoride.perfluoroalkylvinylether copolymer, an ethylene tetrafluoride.propylene hexafluoride copolymer, and an ethylene tetrafluoride.ethylene copolymer; fluorine resins such as fluorine-containing polybenzoxazole; acrylic resins; methacrylic resins such as methyl polymethacrylate; polyacrylonitriles; acrylonitrile copolymers such as an acrylonitrile.butadiene.styrene copolymer; polystyrenes; polystyrene halides; styrene copolymers such as a styrene.methacrylic acid copolymer and a styrene.acrylonitrile copolymer; ionic polymers such as sodium polystyrenesulfonate and sodium polyacrylate; acetal resins; polyamides such as nylon 66; gelatine; gum arabic; polycarbonates; polyestercarbonates; cellulose resins; phenolic resins; urea resins; epoxy resins; unsaturated polyester resins; alkyd resins; melamine resins; polyurethanes; diallylphthalate resins; polyphenylene oxides; polyphenylene sulfides; polysulfones; polyphenylsulfones; silicone resins; polyimides; bismaleimidotriazine resins; polyimidoamides; polyethersulfones; polymethylpentenes; polyetheretherketones; polyetherimides; polyvinylcarbazoles; norbornene amorphous polyolefins; and polyester fumarate.

In dispersing the recording material in inorganic glass, it is preferable to use inorganic glass formable by a so-called sol-gel method. In this method, it is desirable that the gelation temperature be not so high. In impregnating a porous substrate with the recording material, a porous substrate made from various inorganic compounds can be used. In intercalating the recording material into a layered substance, it is possible to use a layered substance such as mica, clay mineral, talc, or chlorite.

In microcapsulating the recording material, the recording material is encapsulated in a transparent film by, e.g., any of interface polymerization, in-situ polymerization, submerged setting covering, phase separation from an aqueous solution system, phase separation from an organic solution system, fusion dispersion cooling, air suspension, and spray drying. These methods can be properly selected in accordance with the application and form of the rewritable thermal recording medium.

Examples of the material of the transparent film for encapsulating the recording material are thermosetting resins such as condensation polymers, e.g., a melamine resin, an epoxy resin, a urea resin, a phenolic resin, and a furan resin, and three-dimensional crosslinking vinyl polymers, e.g., a styrene-divinylbenzene copolymer and a methylmethacrylate-vinylacrylate copolymer. A thermoplastic resin as the material of the binder polymer described above can also be used as the material of the transparent film. This microcapsule transparent film can also be formed as a multilayered film by using two or more types of resins selected from the above-mentioned thermosetting resins and thermoplastic resins. If this is the case, it is preferable to use a thermosetting resin as the outermost shell of the transparent film in order to improve the thermal stability of the microcapsule.

In forming the display regions 7 to 9 by using the above microcapsules, the microcapsules can also be dispersed in the binder polymer or the inorganic glass described above. If the dispersibility of the recording material to the medium such as the binder polymer or the inorganic glass is low, a good dispersed state can be obtained by dispersing the microcapsulated recording material in the medium.

It is also possible to form the display regions 7 to 9 by dispersing the microcapsules in a predetermined liquid to prepare a dispersion and applying and drying this dispersion on the substrate 4. If this is the case, color images can be easily displayed by forming the microcapsules using coloring compounds which develop different colors, and applying the microcapsules into a desired pattern. Additionally, when different types of microcapsules, which differ from each other in color in the colored state, crystallization temperature $T_c$ and melting point $T_m$ of the recording material contained, and color condition (whether the colored state or the decolorized state) in equilibrium, are mixed at a desired ratio and used in a display region, it is possible to develop a desired color in accordance with the amount of applied thermal energy. Accordingly, a multi-color display or a full-color display is possible by forming microcapsules by using, e.g., cyan, magenta, and yellow coloring compounds.

As described above, when the recording material is formed into clusters by using microcapsulation or the like, these clusters are partitioned by the transparent film or the transparent film and the medium such as the binder polymer. Also, the grain size of this cluster is smaller than the pixel size or within the range of the thickness of the display regions 7 to 9 described above. Therefore, phase separation of the recording material occurs in fine regions, so the components of the recording material move only short distances when the recording material changes between the equilibrium state and the quasi-equilibrium state. Additionally, the recording materials do not mix between adjacent display regions. Accordingly, the repeatability of recording and erasure and the storage stability of recording can be increased by the use of the microcapsulated recording material. Furthermore, when the recording material is microcapsulated, the recording material is readily formed into ink. Moreover, a multi-color display is possible by mixing microcapsules for displaying different colors to form a uniform mixture and forming one display region by this mixture, or by stacking microcapsules for displaying different colors in the same display region.

The rewritable thermal recording medium 1 according to the first embodiment of the present invention can have the member 2 made of, e.g., paper on the back surface of the substrate 4 away from the surface on which the recording layer 5 is formed. Although the material of the member 2 is not particularly limited, the material is preferably a card such as a prepaid card. Presently, various cards are put into practical use, and some color images are formed on most of these cards. As described above, the rewritable thermal recording medium 1 can display a complicated color image and can also record and erase information on or from the image. Therefore, a card having a high value added can be obtained by adhering a substrate 4 on which a recording layer 5 is formed to the surface of an existing card 2.

Note that the substrate 4 can be adhered to the member 2 by, e.g., the adhesive layer 3 made of an adhesive. The same adhesive as used to adhere the heat-resistant film and the recording layer 5 can be used as the adhesive for adhering the substrate 4 and the member 2.

As described previously, recording and erasure of information to the rewritable thermal recording medium according to the first embodiment of the present invention are performed by controlling the magnitude of the thermal energy to be applied or by heating to the melting point $T_m$ or higher and controlling the cooling rate.

When information recording and erasure are to be controlled by the magnitude of the thermal energy, information is preferably recorded by using a heat source such as a thermal head, e.g., a TPH or a laser beam. Although the resolving power of a thermal head is not so high, a thermal head can heat a large area and is advantageous in miniaturizing the apparatus. When a laser beam is used, on the other hand, it is possible by decreasing the spot diameter to perform high-density recording and increase the recording erase rate. When a laser beam is to be used, however, it is preferable that a light absorbing layer having an absorption band at the wavelength of the laser beam be formed between the recording layer 5 and the substrate 4 or a compound having an absorption band at the wavelength of the laser beam be contained in the recording material. Consequently, the laser beam can be efficiently absorbed even in a recording material having high light transmittance.

Also, when information recording and erasure are to be controlled by the magnitude of the thermal energy, information is preferably erased by a hot stamp method or a heat roll method because these methods can heat the whole rewritable thermal recording medium 1 at once. Note that the first embodiment of the present invention uses a negative recording material having a relatively high heat resistance and a positive recording material having a relatively low heat resistance. Therefore, heating for information erasure is preferably done at a temperature lower by 30° C. or more than the melting point of the positive recording material.

When information recording and erasure are to be controlled by the cooling rate, the recording material can be rapidly cooled by using a cold stamp, a cold roll, a cold air, or a Peltier element.

Overwrite recording can also be performed for the rewritable thermal recording medium according to the first embodiment of the present invention by using thermal heads which supply different thermal energies or laser apparatuses which output laser beams with different energies.

The second embodiment of the present invention will be described below. A rewritable thermal recording medium according to the second embodiment of the present invention is substantially the same as the first rewritable thermal recording medium except for the structure of a recording layer, and the materials used and the like are the same as described in the first embodiment. Therefore, the same explanations as in the first embodiment will be omitted.

Figure 4A:
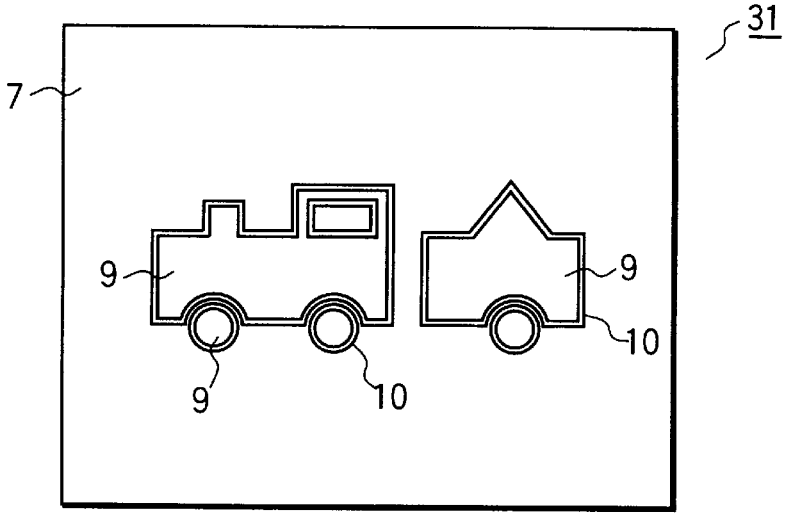
FIGS. 4A and 4B are plan and sectional views, respectively, showing a rewritable thermal recording medium according to the second embodiment of the present invention.
Figure 4B:
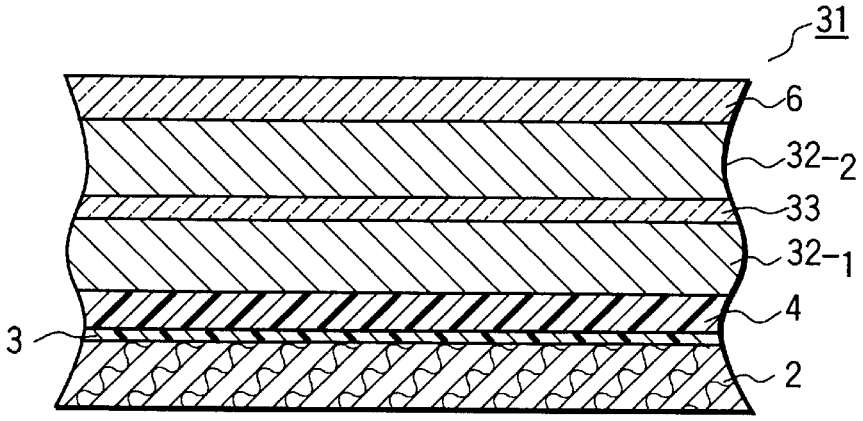

FIGS. 4A and 4B are plan and sectional views, respectively, of the rewritable thermal recording medium according to the second embodiment of the present invention.

In a rewritable thermal recording medium 31 shown in FIGS. 4A and 4B, a first recording layer 32-1, a separation layer 33, a second recording layer 32-2, and a protective layer 6 are stacked in this order on a substrate 4. Additionally, a member 2 is formed via an adhesive layer 3 on the back surface of the substrate 4 away from the surface on which the recording layer 32-1 is formed. As shown in FIG. 4A, the first recording layer 32-1 is constituted by a display region 7, a display region 9, and a partition 10 which partitions the display regions 9 and 10. Negative recording materials are used in the display regions 7 and 9. These negative recording materials develop blue and red, respectively, in equilibrium and lose their color in quasi-equilibrium. Therefore, when the recording materials used in the display regions 7 and 9 are in equilibrium, as shown in FIG. 4A, an image representing a blue sky and a red train is formed in the first recording layer 32-1.

The second recording layer 32-2 covers the display regions 7 and 9 and the partition 10 and is made from a positive recording material. The positive recording material forming the second recording layer 32-2 loses its color in equilibrium and develops black in quasi-equilibrium. Accordingly, when all of the recording materials used in the rewritable thermal recording medium 31 are in equilibrium, the positive recording material is transparent as a consequence, the image shown in FIG. 4A is displayed. Referring to FIG. 4A, the rewritable thermal recording medium 31 displays a blue sky and a red train. However, some other image can also be displayed.

The rewritable thermal recording medium 31 according to the second embodiment of the present invention can display complicated images because the recording layer 32-1 having negative recording materials and the recording layer 32-2 having a positive recording material are stacked. For example, the rewritable thermal recording medium 31 in which all of the recording materials are in equilibrium is heated by a TPH or the like to quasi-equilibrate the recording materials in the recording layers 32-1 and 32-2. Consequently, the negative recording layer 32-1 loses its color and the positive recording layer 32-2 takes on color. That is, the image formed in the recording layer 32-1 is erased, and the recording layer 32-2 displays black. By using this recording method, it is possible to form character images in the positive recording layer 32-2 and display black characters on the image formed in the recording layer 32-1.

Also, when the rewritable thermal recording medium 31 in which all of the recording materials are in equilibrium is irradiated with a laser beam to heat only the negative recording layer 32-2 to a predetermined temperature, only the recording materials contained in the negative recording layer 32-2 can be quasi-equilibrated. In this state, the positive recording layer 32-1 loses its color, and the portion of the negative recording layer 32-2 irradiated with the laser beam also loses its color. Therefore, white solid characters can be displayed in the image formed in the recording layer 32-1 by forming white solid character images in the negative recording layer 32-2 while maintaining the decolorized state of the positive recording layer 32-1.

In either case, the recorded information can be erased by the heat treatment explained in the first embodiment for the recording layers 32-1 and 32-2.

As described above, the rewritable thermal recording medium according to the second embodiment of the present invention can display at least three colors in the same display region. Therefore, intricate color images can be displayed.

Also, the rewritable thermal recording medium according to the second embodiment of the present invention is formed by stacking the first recording layer 32-1 having negative recording materials which take on color in equilibrium and the second recording layer 32-2 having a positive recording material which loses its color in equilibrium. That is, in the rewritable thermal recording medium according to the second embodiment of the present invention, recording layers largely different in light absorbance in equilibrium are stacked. Therefore, when these recording layers are irradiated with light, only the recording layer having high light absorbance can be selectively heated. Furthermore, when these recording layers are heated by using conduction of heat, the recording layers can be readily heated at the same time. That is, when the rewritable thermal recording medium according to the second embodiment of the present invention is used, complicated color images can be easily and accurately displayed by properly selecting the heating method.

In the above rewritable thermal recording medium 31, it is necessary to prevent the mixing of the negative recording materials contained in the first recording layer 32-1 and the positive recording material contained in the second recording layer 32-2. For this purpose, it is preferable to form a separation layer 33 for partitioning the first and second recording layers 32-1 and 32-2. The separation layer 33 is not particularly restricted as long as the layer is transparent and prevents the mixing of the recording materials between the recording layers 32-1 and 32-2. When the individual recording materials are microcapsulated, the separation layer 33 need not be formed.

In the above rewritable thermal recording medium 31, it is not always necessary to form the member 2 and the adhesive layer 3. However, as described in the first embodiment, a card having a high value added can be obtained by forming a member 2 such as a card.

In the second embodiment of the present invention described above, the recording layer 32-1 is negative, and the recording layer 32-2 is positive. However, these recording layers 32-1 and 32-2 can also be made positive and negative, respectively. Information recording and erasure in this case can also be performed by the same methods as described above.

The present invention will be described in more detail below by way of its examples.

EXAMPLE 1

The rewritable thermal recording medium 1 shown in FIGS. 1A and 1B was manufactured by the following method. In this example, the partition 10 was not formed.

First, 1.0 part by weight of crystal violet lactone (CVL) which was a blue leuco dye as a coloring compound, 1.0 part by weight of a phenolic compound represented by formula (1) below as a developer, 10 parts by weight of pregnenolone represented by formula (2) below as a reversing agent, and 3 parts by weight of polymethylmethacrylate as a binder polymer were mixed. The resultant mixture was dispersed in toluene to prepare a first dispersion.

(1)

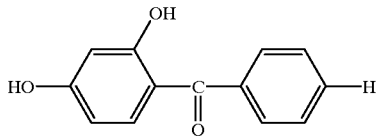

(2)

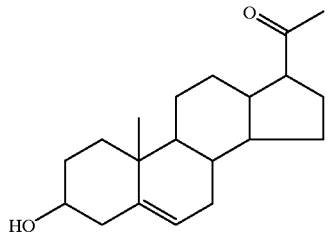

Next, 1.0 part by weight of indolial red (manufactured by Yamamoto Chemicals Inc.) which was a red fluoran dye as a coloring compound, 1.0 part by weight of a phenolic compound represented by formula (1) above as a developer, 10 parts by weight of pregnenolone represented by formula (2) above as a reversing agent, and 0.5 parts by weight of polymethylmethacrylate as a binder polymer were mixed. The resultant mixture was dispersed in toluene to prepare a second dispersion.

Additionally, 1.0 part by weight of PSD-150 (manufactured by Nippon Soda Co., Ltd.) which was a black fluoran dye as a coloring compound, 1.0 part by weight of a bisphenolic compound having a long-chain alkyl group represented by formula (3) below as a developer, and 0.2 parts by weight of polymethylmethacrylate as a binder polymer were mixed. The resultant mixture was dispersed in toluene to prepare a third dispersion.

(3)

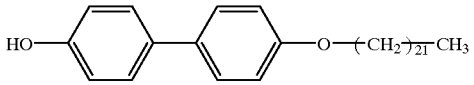

By using the first to third dispersions prepared as described above, a 10-$\mu$m thick recording layer 5 was formed on a 50-$\mu$m thick PET film 4 by screen printing. Note that display regions 7, 8, and 9 were formed by using the first, third, and second dispersions, respectively.

Subsequently, the film 4 was adhered to the paper card 2 by an adhesive 3. In addition, a photosetting epoxy resin was applied on the recording layer 5 and set by irradiation of light to form a 0.4-$\mu$m thick protective film 6.

The rewritable thermal recording medium 1 thus obtained was pressed by a heat roll and naturally cooled at room temperature to crystallize the recording materials contained in the display regions 7 to 9, thereby displaying the image shown in FIG. 1A.

A printing test was run for this rewritable thermal recording medium 1 under the conditions of an applied voltage of 12 V and a pulse width of 0.8 msec by using a thermal head (6 dots/mm,380 Ω) available from TOSHIBA CORP. As a result, the recording materials in the printed portions became amorphous to display white characters in the display regions 7 and 9 and black characters in the display region 8.

Next, a hot stamp was pressed on the entire surface of the rewritable thermal recording medium 1 for two seconds, and the medium 1 was left to stand at room temperature. Consequently, the recording materials which were made amorphous by the thermal head turned crystalline to make erasure of the recorded information possible.

The recording and erasure described above were repeated 100 cycles, but the display characteristics did not deteriorate. Also, even after the rewritable thermal recording medium 1 was left to stand at 30° C. for one year, no change was found in the state of the recorded characters.

EXAMPLE 2

The rewritable thermal recording medium 1 shown in FIGS. 1A and 1B was manufactured by the following method. In this example, the partition 10 was not formed.

First, 1.0 part by weight of crystal violet lactone (CVL) which was a blue leuco dye as a coloring compound, 1.0 part by weight of a phenolic compound represented by formula (1) above as a developer, 5 parts by weight of methylandrostenediol represented by formula (4) below as a reversing agent, 5 parts by weight of 1-triacontanol as a phase separation controlling agent, and 3 parts by weight of polystyrene as a binder polymer were mixed. The resultant mixture was dispersed in toluene to prepare a fourth dispersion.

(4)

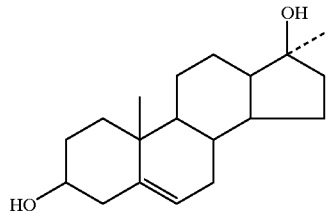

Subsequently, 1.0 part by weight of indolial red (manufactured by Yamamoto Chemicals Inc.) which was a red fluoran dye as a coloring compound, 1.0 part by weight of a phenolic compound represented by formula (1) above as a developer, 5 parts by weight of methylandrostenediol represented by formula (4) above as a reversing agent, and 0.5 parts by weight of polystyrene as a binder polymer were mixed. The resultant mixture was dispersed in toluene to prepare a fifth dispersion.

Additionally, 1.0 part by weight of PSD-150 (manufactured by Nippon Soda Co., Ltd.) which was a black fluoran dye as a coloring compound, 1.0 part by weight of a bisphenolic compound having a long-chain alkyl group represented by formula (5) below as a developer, and 0.2 parts by weight of polymethylmethacrylate as a binder polymer were mixed. The resultant mixture was dispersed in toluene to prepare a sixth dispersion.

(5)

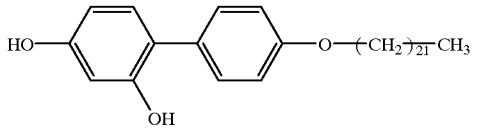

The rewritable thermal recording medium 1 shown in FIGS. 4A and 4B was manufactured following the same procedures as in Example 1 except that the fourth to sixth dispersions prepared as described above were used.

Next, the rewritable thermal recording medium 1 thus obtained was pressed by a heat roll and naturally cooled at room temperature to crystallize the recording materials contained in display regions 7 to 9, thereby displaying the image shown in FIG. 1A.

A printing test was conducted for this rewritable thermal recording medium 1 under the conditions of an applied voltage of 12 V and a pulse width of 0.8 msec by using a thermal head (6 dots/mm, 380 Ω) available from TOSHIBA CORP. As a result, the recording materials in the printed portions changed to be amorphous to display white characters in the display regions 7 and 9 and black characters in the display region 8.

Subsequently, a hot stamp was pressed on the entire surface of the rewritable thermal recording medium 1 for two seconds, and the medium 1 was left to stand at room temperature. Consequently, the recording materials which were made amorphous by the thermal head changed to be crystalline to make erasure of the recorded information possible.

The recording and erasure described above were executed 100 cycles, but the display characteristics did not deteriorate. Also, even after the rewritable thermal recording medium 1 was left to stand at 30° C. for one year, no change was found in the state of the recorded characters.

EXAMPLE 3

The rewritable thermal recording medium 1 shown in FIGS. 1A and 1B was manufactured following the same procedures as in Example 1 except that the partition 10 was formed.

That is, after a 50-μm thick separation layer 10 was formed on a 50-μm thick PET film 4 by screen printing by using black ink, a recording layer 5 and the like were formed to manufacture the rewritable thermal recording medium 1.

Next, the rewritable thermal recording medium 1 thus obtained was pressed by a heat roll and naturally cooled at room temperature to crystallize the recording materials contained in display regions 7 to 9, thereby displaying the image shown in FIG. 1A.

A printing test was performed for this rewritable thermal recording medium 1 under the conditions of an applied voltage of 12 V and a pulse width of 0.8 msec by using a thermal head (6 dots/mm, 380 Ω) available from TOSHIBA CORP. As a result, the recording materials in the printed portions changed to be amorphous to display white characters in the display regions 7 and 9 and black characters in the display region 8. The black partition 10 prevented the mixing of the recording materials between adjacent display regions. Accordingly, even characters printed across two adjacent display regions could be clearly displayed.

Subsequently, a hot stamp was pressed on the entire surface of the rewritable thermal recording medium 1 for two seconds, and the medium 1 was left to stand at room temperature. Consequently, the recording materials which were made amorphous by the thermal head changed to be crystalline to make erasure of the recorded information possible.

After 100 cycles of the recording and erasure described above, the display characteristics did not show any deterioration. Also, even after the rewritable thermal recording medium 1 was left to stand at 30° C. for one year, no change was found in the state of the recorded characters.

EXAMPLE 4

The rewritable thermal recording medium 1 shown in FIGS. 1A and 1B was manufactured by the following method. In this example, the member 2, the adhesive layer 3, and the partition 10 were not formed.

First, by using first to third dispersions prepared following the same procedures as in Example 1, a 5-μm thick recording layer 5 was formed on a 100-μm thick OHP PET film 4 following the same procedures as in Example 1. Subsequently, a photosetting epoxy resin was applied on the recording layer 5 and set by irradiation of light to form a 0.4-μm thick protective film 6.

The rewritable thermal recording medium 1 thus obtained was pressed by a heat roll and rapidly cooled. Consequently, the recording materials contained in the display regions 7 and 9 were quasi-equilibrated, and the recording material contained in the display region 8 was equilibrated. That is, the rewritable thermal recording medium 1 was made transparent.

Next, this rewritable thermal recording medium 1 was pressed by a heat roll and naturally cooled at room temperature to crystallize the recording materials contained in the display regions 7 to 9, thereby displaying the image shown in FIG. 1A. In addition, a printing test was carried out for this rewritable thermal recording medium 1 under the conditions of an applied voltage of 12 V and a pulse width of 0.8 msec by using a thermal head (6 dots/mm, 380 Ω) available from TOSHIBA CORP. As a result, the recording materials in the printed portions changed to be amorphous to display white characters in the display regions 7 and 9 and black characters in the display region 8. This allowed the information recorded in the rewritable thermal recording medium 1 to be displayed on a screen by using an OHP apparatus.

Subsequently, a hot stamp was pressed on the entire surface of the rewritable thermal recording medium 1 for four seconds, and the medium 1 was left to stand at room temperature. Consequently, the recording materials which were made amorphous by the thermal head changed to be crystalline to make erasure of the recorded information possible.

The recording and erasure described above were repeated 100 cycles, but the display characteristics did not deteriorate. Also, even after the rewritable thermal recording medium 1 was left to stand at 30° C. for one year, no change was found in the state of the recorded characters.

EXAMPLE 5

The rewritable thermal recording medium 1 shown in FIGS. 1A and 1B was manufactured by the following method. In this example, the partition 10 was not formed, and each recording material was microcapsulated before being used.

First, 1.0 part by weight of crystal violet lactone (CVL) which was a blue leuco dye as a coloring compound, 1.0 part by weight of a phenolic compound represented by formula (1) above as a developer, and 10 parts by weight of pregnenolone represented by formula (2) above as a reversing agent were mixed. The resultant mixture was fused and rapidly cooled. The produced solid was formed into a fine powder about 5 μm in diameter by using a mortar. The fine powder was then dispersed in an aqueous gelatin solution by using a homogenizer to prepare a seventh dispersion.

Next, 1.0 part by weight of indolial red (manufactured by Yamamoto Chemicals Inc.) which was a red fluoran dye as a coloring compound, 1.0 part by weight of a phenolic compound represented by formula (1) above as a developer, and 10 parts by weight of pregnenolone represented by formula (2) above as a reversing agent were mixed. The resultant mixture was fused and rapidly cooled. The produced solid was formed into a fine powder about 5 μm in diameter by using a mortar. The fine powder was then dispersed in an aqueous gelatin solution by using a homogenizer to prepare an eighth dispersion.

Additionally, 1.0 part by weight of PSD-150 (manufactured by Nippon Soda Co., Ltd.) which was a black fluoran dye as a coloring compound and 1.0 part by weight of a bisphenolic compound having a long-chain alkyl group represented by formula (3) above as a developer were mixed. The resultant mixture was fused and rapidly cooled. The produced solid was formed into a fine powder about 5 μm in diameter by using a mortar. The fine powder was then dispersed in an aqueous gelatin solution by using a homogenizer to prepare a ninth dispersion.

By using the seventh to ninth dispersions prepared as described above, a 10-μm thick recording layer 5 was formed on a 50-μm thick PET film 4 by screen printing following the same procedures as in Example 1. Subsequently, the film 4 was adhered to a paper card 2 by an adhesive 3. In addition, a photosetting epoxy resin was applied on the recording layer 5 and set by irradiation of light to form a 0.4-μm thick protective film 6.

The rewritable thermal recording medium 1 thus obtained was pressed by a heat roll and naturally cooled at room temperature to crystallize the recording materials contained in display regions 7 to 9, thereby displaying the image shown in FIG. 1A.

A printing test was performed for this rewritable thermal recording medium 1 under the conditions of an applied voltage of 15 V and a pulse width of 1 msec by using a thermal head (6 dots/mm, 380 Ω) available from TOSHIBA CORP. As a result, the recording materials in the printed portions turned amorphous to display white characters in the display regions 7 and 9 and black characters in the display region 8.

Next, a hot stamp was pressed on the entire surface of the rewritable thermal recording medium 1 for two seconds, and the medium 1 was left to stand at room temperature. Consequently, the recording materials which were made amorphous by the thermal head changed to be crystalline to make erasure of the recorded information possible.

The recording and erasure described above were performed 100 cycles, but the display characteristics did not deteriorate. Also, even after the rewritable thermal recording medium 1 was left to stand at 30° C. for one year, no change was found in the state of the recorded characters.

EXAMPLE 6

The rewritable thermal recording medium 1 was manufactured following the same procedures as in Example 5 except that a water-soluble yellow dye was added to the ninth dispersion.

The rewritable thermal recording medium 1 thus obtained was pressed by a heat roll and naturally cooled at room temperature to crystallize the recording materials contained in display regions 7 to 9, thereby displaying the image shown in FIG. 1A. Note that the display region 8 was colored with the yellow dye.

A printing test was conducted for this rewritable thermal recording medium 1 under the conditions of an applied voltage of 15 V and a pulse width of 1 msec by using a thermal head (6 dots/mm, 380 Ω) available from TOSHIBA CORP. As a result, the recording materials in the printed portions transformed into amorphous state to display white characters in the display regions 7 and 9 and black characters in the display region 8.

Next, a hot stamp was pressed on the entire surface of the rewritable thermal recording medium 1 for two seconds, and the medium 1 was left to stand at room temperature. Consequently, the recording materials which were made amorphous by the thermal head turned crystalline to make erasure of the recorded information possible.

The recording and erasure described above were repeated 100 cycles, but the display characteristics did not deteriorate. Also, even after the rewritable thermal recording medium 1 was left to stand at 30° C. for one year, no change was found in the state of the recorded characters.

EXAMPLE 7

Figure 5:
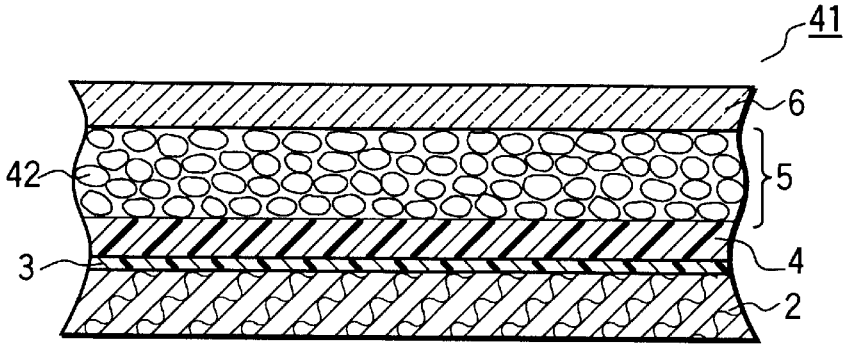
FIG. 5 is a sectional view showing a rewritable thermal recording medium according to examples of the present invention.

A rewritable thermal recording medium 41 shown in FIG. 5 was manufactured by the following method. FIG. 5 is a sectional view showing the rewritable thermal recording medium according to this example of the present invention. In this rewritable thermal recording medium shown in FIG. 5, the display regions 7 to 9 shown in FIG. 1A were formed.

First, 1.0 part by weight of crystal violet lactone (CVL) which was a blue leuco dye as a coloring compound, 1.0 part by weight of a phenolic compound represented by formula (1) above as a developer, 5 parts by weight of methylandrostenediol represented by formula (4) above as a reversing agent, and 5 parts by weight of 1-triacontanol as a phase separation controlling agent were mixed. The resultant mixture was fused and rapidly cooled. 30 parts by weight of the resultant composition and 1 part by weight of melamine prepolymer were mixed, and the mixture was melted by heating. The molten product thus obtained was dropped into 200 g of an aqueous 5-wt % solution of gelatin, and the solution was stirred by a homogenizer to form fine droplets. The resultant aqueous gelatin solution was stirred at a temperature of about 80° C. for five hours while the pH of the solution was controlled to 2 by using hydrochloric acid. In this manner, blue microcapsules 42 in which a recording material consisting of the coloring compound, developer, and reversing agent was encapsulated in a transparent film made from a melamine resin were formed.

Next, 1.0 part by weight of indolial red (manufactured by Yamamoto Chemicals Inc.) which was a red fluoran dye as a coloring compound, 1.0 part by weight of a phenolic compound represented by formula (1) above as a developer, and 10 parts by weight of pregnenolone represented by formula (2) above as a reversing agent were mixed. The resultant mixture was fused and rapidly cooled. Except that the composition thus obtained was used, red microcapsules 42 were formed following the same procedures as above.

Additionally, 1.0 part by weight of PSD-150 (manufactured by Nippon Soda Co., Ltd.) which was a black fluoran dye as a coloring compound and 1.0 part by weight of a bisphenolic compound having a long-chain alkyl group represented by formula (3) above as a developer were mixed. The resultant mixture was fused and rapidly cooled. Except that the composition thus obtained was used, black microcapsules 42 were formed following the same procedures as above.

The blue, red, and black microcapsules 42 thus formed were dispersed in water to prepare first, second, and third microcapsule dispersions, respectively. In addition, equal amounts of the second and third microcapsule dispersions were mixed to prepare a fourth microcapsule dispersion.

The rewritable thermal recording medium 1 as shown in FIGS. 1A and 1B was manufactured following the same procedures as in Example 1 except that the first, third, and fourth microcapsule dispersions prepared as described above were used. Note that the display regions 7, 8, and 9 were formed by using the first, third, and fourth microcapsule dispersions, respectively.

The rewritable thermal recording medium 41 thus obtained was pressed by a heat roll and naturally cooled at room temperature to crystallize the recording materials contained in the display regions 7 to 9, thereby displaying the image shown in FIG. 1A.

A printing test was performed for this rewritable thermal recording medium 41 under the conditions of an applied voltage of 12 V and a pulse width of 0.8 msec by using a thermal head (6 dots/mm, 380 Ω) available from TOSHIBA CORP. As a result, the recording materials in the printed portions became amorphous to display white characters in the display region 7 and black characters in the display regions 8 and 9.

Next, a hot stamp was pressed on the entire surface of the rewritable thermal recording medium 41 for 0.2 second, and the medium 41 was left to stand at room temperature. Consequently, only the amorphous recording material in the display region 7 turned crystalline to make erasure of the recorded information possible only in the display region 7. The hot stamp was again pressed on the entire surface of this rewritable thermal recording medium 41, and the medium 41 was left to stand at room temperature. As a consequence, the recorded information could be erased in all of the display regions.

When the recording and erasure described above were performed 100 cycles, the display characteristics did not show any deterioration. Also, even after the rewritable thermal recording medium 41 was left to stand at 30° C. for one year, no change was found in the state of the recorded characters.

EXAMPLE 8

The rewritable thermal recording medium 31 shown in FIGS. 4A and 4B was manufactured by the following method. In this example, the partition 10 was not formed.

First, by using first and second dispersions prepared following the same procedures as in Example 1, a 10-μm thick first recording layer 32-1 was formed on a 50-μm thick PET film 4 by screen printing. Note that display regions 7 and 9 were formed by using the first and second dispersions, respectively.

Subsequently, a 10-μm thick gelatin film 33 was formed on the first recording layer 32-1. In addition, the gelatin film 33 was coated with a third dispersion prepared following the same procedures as in Example 1 to form a 10-μm thick second recording layer 32-2.

Next, the film 4 was adhered to a paper card 2 by an adhesive 3. Furthermore, a photosetting epoxy resin was applied on the second recording layer 32-2 and set by irradiation of light to form a 0.4-μm thick protective film 6.

The rewritable thermal recording medium 31 thus obtained was pressed by a heat roll and naturally cooled at room temperature to crystallize the recording materials contained in the display regions 7 to 9, thereby displaying the image shown in FIG. 4A.

A printing test was performed for this rewritable thermal recording medium 31 under the conditions of an applied voltage of 12 V and a pulse width of 0.8 msec by using a thermal head (6 dots/mm, 380 Ω) available from TOSHIBA CORP. As a result, the recording materials in the printed portions became amorphous to display black characters in the display regions 7 and 9.

Next, a hot stamp was pressed on the entire surface of the rewritable thermal recording medium 31 for four seconds, and the medium 31 was left to stand at room temperature. Consequently, the recording materials which were made amorphous by the thermal head turned crystalline to make erasure of the recorded information possible.

Subsequently, printing was performed by irradiating a 3-mW SHG semiconductor laser beam at a wavelength of 430 nm by focusing the beam onto the first recording layer 32-1. As a consequence, the recording material in the first recording layer 32-1 irradiated with the laser beam changed to be amorphous to display white solid characters.

The hot stamp was pressed on the entire surface of this rewritable thermal recording medium 31 for four seconds, and the medium 1 was left to stand at room temperature. Consequently, the recording materials which were made amorphous by the laser beam turned crystalline to make erasure of the recorded information possible.

The recording and erasure described above were performed 100 cycles, but the display characteristics did not deteriorate. Also, even after the rewritable thermal recording medium 1 was left to stand at 30° C. for one year, no change was found in the state of the recorded characters.

In the rewritable thermal recording medium of the present invention as has been described above, a display region having a negative recording material and a display region having a positive recording material are juxtaposed. The negative recording material takes on color in equilibrium, and the positive recording material loses its color in equilibrium. Therefore, the rewritable thermal recording medium of the present invention can display complicated color images having various colors from light colors to dark colors without changing the recording materials from equilibrium to quasi-equilibrium. It is also possible to easily display another information such as characters or images on the color image formed in equilibrium. That is, more elaborate color images can be displayed.

Also, in the rewritable thermal recording medium of the present invention, a first recording layer having a negative recording material and a second recording layer having a positive recording material are stacked. The negative recording material has high light absorbance in equilibrium, and the positive recording material has low light absorbance in equilibrium. Therefore, complicated color images can be easily and accurately displayed by properly selecting irradiation of light or conduction of heat in heating the recording layers. In addition, at least three colors can be displayed in the same display region.

Furthermore, the recording method of the present invention can heat the above rewritable thermal recording medium by irradiation of light and conduction of heat. Accordingly, complicated color images can be easily and accurately recorded.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A rewritable thermal recording medium using recording material which reversibly changes between an equilibrium state and a quasi-equilibrium state different in color condition from the equilibrium state when a predetermined heat treatment is performed, comprising:

a substrate;

a first recording layer formed on said substrate and containing a first recording material which takes on lighter color in quasi-equilibrium than in equilibrium; and a second recording layer formed on said substrate to juxtapose with said first recording layer and containing a second recording material which takes on darker color in quasi-equilibrium than in equilibrium.

2. A medium according to claim 1, further comprising a partition which prevents mixing of said first and second recording materials between said first and second layers and is not denatured by the heat treatment.

3. A medium according to claim 1, wherein at least one of said first and second recording materials is substantially crystalline in equilibrium and substantially amorphous in nonequilibrium.

4. A medium according to claim 1, wherein at least one of said first and second layers contains a dye which does not change a color condition due to the heat treatment.

5. A medium according to claim 1, wherein said first recording material contains a coloring compound, a developer, and a reversing agent.

6. A medium according to claim 5, wherein said reversing agent is a compound having a steroid skeleton.

7. A medium according to claim 1, wherein said second recording material contains a coloring compound and a developer.

8. A medium according to claim 7, wherein a melting point of said developer is not less than 100° C.

9. A medium according to claim 1, further comprising a transparent film, which disperses at least one of said first and second recording materials into clusters, on said substrate.

10. A medium according to claim 1, wherein at least one of said first and second recording materials is encapsulated with transparent films into microcapsules.

11. A rewritable thermal recording medium using a recording material which reversibly changes between an equilibrium state and a quasi-equilibrium state different in color condition from the equilibrium state when a predetermined heat treatment is performed, comprising:

a substrate;

a first recording layer stacked on said substrate; and a second recording layer stacked on said first recording layer, wherein one of said first and second recording layers containing a first recording material which takes on lighter color in quasi-equilibrium than in equilibrium, and the other recording layer containing a second recording material which takes on darker color in quasi-equilibrium than in equilibrium.

12. A medium according to claim 11, wherein said first recording layer contains said first recording material, and said second recording layer contains said second recording material.

13. A medium according to claim 11, wherein at least one of said first and second recording materials is substantially crystalline in equilibrium and substantially amorphous in nonequilibrium.

14. A medium according to claim 11, wherein said first recording material contains a coloring compound, a developer, and a reversing agent.

15. A medium according to claim 14, wherein said reversing agent is a compound having a steroid skeleton.

16. A medium according to claim 11, wherein said second recording material contains a coloring compound and a developer.

17. A medium according to claim 16, wherein a melting point of said developer is not less than 100° C.

18. A medium according to claim 11, wherein at least one of said first and second recording layers comprises a transparent film which disperses said recording material into clusters.

19. A medium according to claim 11, wherein at least one of said first and second recording materials is encapsulated with transparent films into microcapsules.

20. A method of recording information on the medium according to claim 11, comprising the steps of:

recording on said recording layer containing said first recording material by using irradiation of light; and recording on said recording layer containing said second recording material by using conduction of heat.

* * * * *